United States Patent [19]

Krebs

[11] Patent Number: 4,940,515

[45] Date of Patent: Jul. 10, 1990

[54] IMBEDDED MESH IN SUCTION BOX COVER

[75] Inventor: David J. Krebs, East Schodack, N.Y.

[73] Assignee: Albany International Corp., Menands, N.Y.

[21] Appl. No.: 372,883

[22] Filed: Jun. 28, 1989

[51] Int. Cl.[5] ..... D21F 1/52

[52] U.S. Cl. ..... 162/363; 162/352; 162/374

[58] Field of Search ..... 162/352, 354, 374, 368, 162/363, 364

[56] References Cited

U.S. PATENT DOCUMENTS

| | | | |
|---|---|---|---|
| 2,991,218 | 7/1961 | Cirrito et al. | 162/357 |
| 3,017,928 | 1/1962 | Pedrick | 162/374 |
| 3,067,816 | 12/1962 | Gould | 162/374 |
| 3,365,359 | 1/1968 | Proulx | 162/374 |
| 3,507,746 | 4/1970 | Rhine | 162/363 |
| 4,214,949 | 7/1980 | Schiel et al. | 162/374 |

*Primary Examiner*—Karen M. Hastings

*Attorney, Agent, or Firm*—Kane, Dalsimer, Sullivan, Kurucz, Levy, Eisele and Richard

[57] ABSTRACT

An improved suction box for paper making machine includes a cover for contacting a press fabric with an elongated slot. The slot is covered with a mesh to eliminate noise and reduce wear on the fabric.

4 Claims, 1 Drawing Sheet

A12

IMBEDDED MESH IN SUCTION BOX COVER

BACKGROUND OF THE INVENTION a. Field of Invention

This invention pertains to an improved cover for a suction box used in papermaking machines, wherein water is removed from a moving fabric or web by suction.

b. Description of the Prior Art

Various types of paper may be made at high speed and economically on so-called papermaking machines. In a papermaking machine, a slurry of wood pulp or other materials is dispensed onto an endless forming fabric. The forming fabric with the slurry moves past several suction boxes used to remove water from the slurry to form a continuous paper sheet. Since this sheet still has a high water content, it is usually transferred to a press section where it is contacted with at least one continuous press fabric and fed through press nips for the further removal of water by mechanical compression. The press fabric is then passed over a suction box where water is removed from the fabric. Thus the press fabric may be used in a continuous process.

One common type of suction box is provided with a cover having a slot extending across the full width of the press fabric. The slot is generally in the range of ⅜ to 3 inches in machine direction width. (The suction box is described herein as part of the press section of the papermaking machine, however it should be understood that it may also be used in the paper forming section). This type of suction box has been found to be unsatisfactory for a number of reasons. For example, as the seam of a machine seamable press fabric as described in U.S. Pat. No. 4,601,785 passes over the slot, the fabric makes a loud, unpleasant popping sound which increases the overall noise level produced by the machine. Also, as the seam passes over the slot in the suction box, it rubs against the slot edges causing the seam flap, formed of batt material, to wear out before the rest of the fabric. Thus, the useful life of the press fabric is reduced drastically. The fabric may also fail due to the flexing of the fabric adjacent to the seam due to the movement of the seam caused by vacuuming down into the slot.

OBJECTIVES AND SUMMARY OF THE INVENTION

In view of the above-mentioned disadvantages of the existing suction box covers, it is an objective of the present invention to provide an improved suction box cover which has no pronounced slot edges presented to the press fabric, thereby extending the useful life of the press fabric.

A further objective is to provide an improved box cover in which the flexing of the fabric at the slot is eliminated.

Yet another objective is to provide an improved box cover which reduces or eliminates the sound produced by prior art box covers. Since overall wear can be reduced by preventing the flexing of the fabric down into a slot, the batt layer of both on machine seamed fabrics and regular, endless press fabrics will also be exposed to less mechanical wear from the slot edges.

Other advantages of the invention shall become apparent from the following description of the invention. Briefly, the suction box constructed in accordance with this invention comprises a main body connected to a vacuum source to provide suction. A cover is secured to the box and is constructed and arranged to support a fabric moving continuously across it. The box cover is provided with a slot extending substantially across the width of the fabric and in communication with the main body of the box to apply suction to the fabric, to remove water therefrom. Advantageously, a wire (which could be a perforated sheet of steel, plastic, etc.) mesh is imbedded in the top section of the slot, covering the entire slot opening. The mesh prevents the fabric and its seam from deflection into the slot.

DETAILED DESCRIPTION OF THE INVENTION

Figure 2:
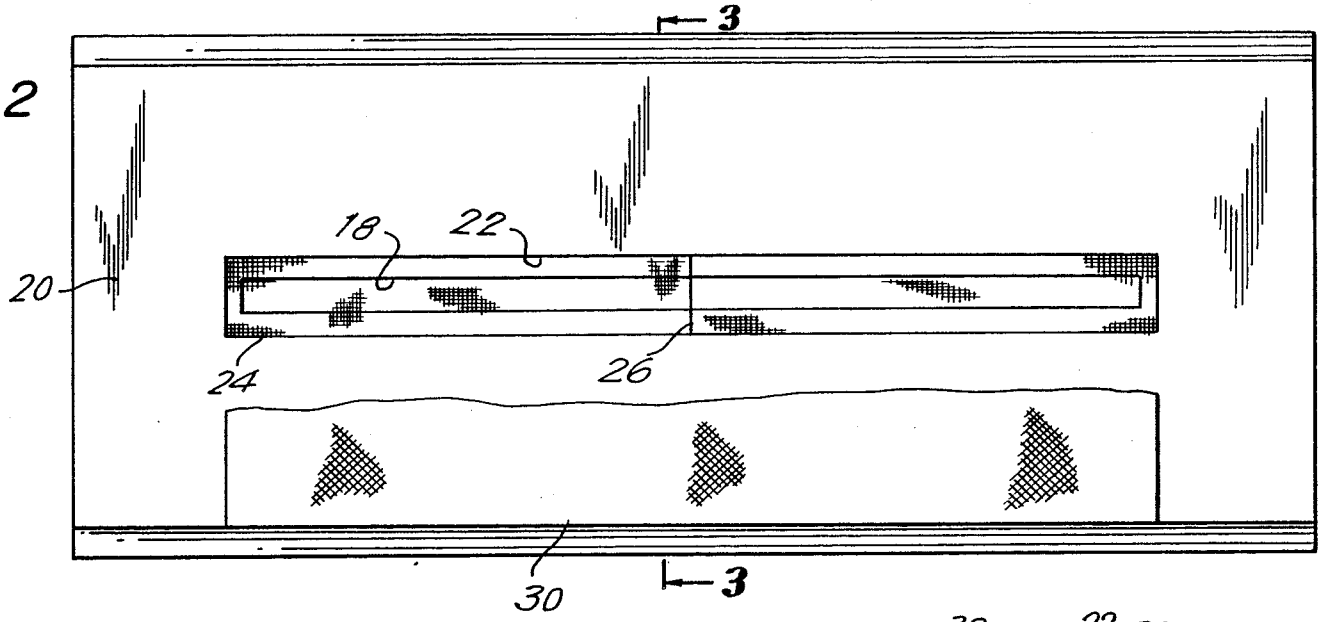
FIG. 2 shows a plan view of the cover of FIG. 1.
Figure 3:
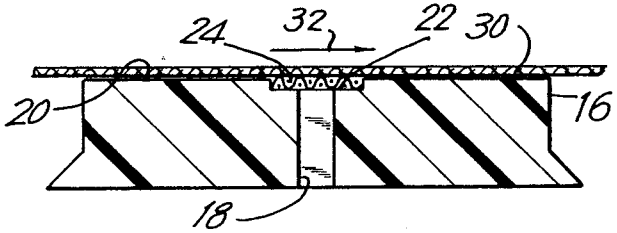
FIG. 3 shows a side sectional view of the cover of FIGS. 1 and 2.
Figure 1:
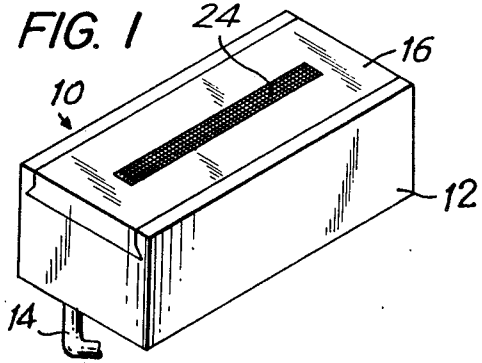
FIG. 1 shows an isometric view of a suction box with an improved cover constructed in accordance with the invention.

Referring now to the Figures, a suction box 10 constructed in accordance with this invention includes a main body 12 which is connected to a vacuum source (not shown) by a connecting pipe 14. The box is provided with a solid cover 16 which is secured to the main body in a known manner. For example in FIG. 1, the cover 16 is secured to the main body in a dovetail joint, however other types of connections are equally suitable.

The cover is provided with a continuous slot 18 having a substantially uniform cross-section extending substantially along its length as shown. On the flat top surface 20 of the cover, there is a recess 22 surrounding slot 18. This recess may be for example about ¼ inch wide. Disposed in this recess is a wire mesh 24 preferably in a manner such that it is coplanar with the top surface 20. The mesh 24 may be secured to cover 16 by various means including mechanical means (i.e. screws, clips or other fasteners designed to retain the mesh in the recessed area on both sides of the slot); chemical means (i.e. by application of a silicone or other type of adhesive); by molding the mesh integrally with the cover (if both the mesh and cover are made of a plastic material); or by sliding the mesh into grooves (not shown) precut on two opposite longitudinal edges of the slot.

Depending on the length of slot 18, the wire mesh may be made from a single piece or from two pieces butted together as at 26. The mesh is selected so that it provides a support for the press fabric without letting it protrude into the slot 18. The mesh has a plurality of holes such as 28 which are large enough so that as water is extracted from the fabric, the holes are not plugged up by papermaking fillers.

The operation of the suction box with the improved cover shall now be described. The suction box is disposed in a paper machine, such as for example its press section, transverse to the continuous path of a press fabric. The press fabric 30 passes over the cover in a continuous movement indicated by the arrow 32. The vacuum in suction box 10 extracts water from the fabric through slot 18 and mesh 24. The mesh is constructed and arranged to fit in recess 22 to support the fabric. Therefore the mesh prevents any contact between the fabric and the side walls defining slot 18, thereby eliminating undesirable noise, and reducing the wear on the fabric and its seam (not shown). As previously mentioned, the suction box may also be disposed in the forming section for removing water directly from a paper web through a forming fabric.

Preferably, the cover is molded from a high impact plastic material with a low coefficient of friction such as polyethylene. The wire mesh is preferably made of stainless steel, but could also be made of synthetic polymer materials.

Obviously numerous modifications may be made to this invention without departing from its scope as defined in the appended claims.

I claim:

1. In a paper making machine having a press fabric for removing water from a paper sheet, a suction box comprising:

a fixed box body connected to a source of vacuum;

a solid cover secured to said box body and having a substantially flat surface for contacting said press fabric, said surface having a continuous slot with two opposed side walls and a uniform cross-section therebetween, said side walls extending substantially along the width of said press fabric, said slot being in communication with said box body for removing water from said press fabric by suction; and a fixed mesh imbedded in said cover and covering said slot for preventing contact between said press fabric and said side walls.

2. The suction box of claim 1 wherein said mesh is coplanar with said contact surface.

3. The suction box of claim 1 wherein said cover includes means for defining a recess surrounding said slot, and said mesh is disposed in said recess.

4. The suction box of claim 1 wherein said mesh is substantially coextensive with said slot.

* * * * *